US005992339A

United States Patent [19]

Mack

[11] Patent Number: 5,992,339

[45] Date of Patent: Nov. 30, 1999

[54] ALIGNMENT APPARATUS FOR TUBULAR HOOPING DEVICE

[76] Inventor: Charles H. Mack, W152 N7406 Westwood Dr., Menomonee Falls, Wis. 53051

[21] Appl. No.: 09/185,264

[22] Filed: Nov. 3, 1998

[51] Int. Cl.[6] ..... D05C 9/04

[52] U.S. Cl. ..... 112/103; 38/102.2

[58] Field of Search ..... 112/103, 470.14, 112/475.18, 75, 66; 38/102.2; 33/653, 645, 613, 533, 1 BB, 430

[56] References Cited

U.S. PATENT DOCUMENTS

| | | | |
|---|---|---|---|
| 845,453 | 2/1907 | Elliott | 112/75 |
| 2,387,986 | 10/1945 | Evans | 33/180 |
| 3,973,507 | 8/1976 | Sambus | 112/152 |
| 4,762,076 | 8/1988 | Wakaizumi | 112/103 |
| 4,774,778 | 10/1988 | Williams | 38/102.2 |
| 4,869,183 | 9/1989 | Moore, III | 112/103 |
| 5,465,498 | 11/1995 | Lycan | 33/645 |
| 5,842,430 | 12/1998 | Mack | 112/103 |
| 5,884,571 | 3/1999 | Valadez et al. | 112/103 |

*Primary Examiner*—John J. Calvert
*Assistant Examiner*—Tejash Patel
*Attorney, Agent, or Firm*—Ryan Kromholz & Manion, S.C.

[57] ABSTRACT

Aligning apparatus for use with a tubular hooping device for capturing a garment to be embroidered on an embroidery machine between two hoop portions. A first apparatus includes a disc sized to fit within the male hoop portion. Registration marks are inscribed on the disk for alignment with the garment. A second apparatus is affixed to the tubular hooping device and provides a guide for alignment with an edge of the garment to be embroidered. Methods for using each aligning device are also disclosed.

8 Claims, 5 Drawing Sheets

ALIGNMENT APPARATUS FOR TUBULAR HOOPING DEVICE

BACKGROUND OF THE INVENTION

The present invention relates generally to the field of embroidering and specifically to the use of a hooping device to ensure the proper location and alignment of an article of clothing in an embroidery machine.

Embroidery is an attractive and popular method of decorating articles of clothing. It is also an effective and much used method of advertising. The popularity of embroidery and the need to embroider large numbers of garments in a short length of time has spawned the invention of machines able to embroider a plurality of garments at one time.

In like manner to hand embroidery, hoops are used to secure a garment beneath the sewing heads of an embroidery machine. The instant invention is drawn to the use of what are called tubular hoops. In the field of embroidery, the term tubular refers to the configuration of the garment or other workpiece to be embroidered. Shirts, jackets, stockings, caps, sleeves, and the like are considered to be tubular garments. Tubular garments are difficult to embroider, as they tend to be awkward to position in an embroidery machine. To remedy the difficulties inherent in embroidering tubular garments, a system of suspending the portion of the tubular garment to be embroidered beneath a sewing head of an embroidery machine has been developed. This system comprises the use of tubular hoops. Tubular hoops are comprised of a larger and a smaller circular section of a hollow cylinder. The larger hoop is called the female hoop portion and is sized so as to frictionally receive in its inner diameter the smaller hoop, which is called the male portion. The hoops are used to secure and to stretch a piece of fabric or a portion of a garment that is to be embroidered. As is well known, the portion of the garment to be embroidered is placed between the male and female hoop portions. Once the portion of the garment to be embroidered is properly framed by the hoop portions, the male hoop portion is seated within the female hoop portion, thereby catching a portion of the garment between the inner diameter of the female hoop portion and the outer diameter of the male hoop portion. The garment is retained between the hoop portions by the friction fit of the hoop portions, the magnitude of the friction force being enhanced by the added thickness of the garment caught therebetween.

It is the practice of the embroidering industry to provide attachment means upon one of the hoop portions, generally the male hoop portion, so as to permit the hoop portions and the garment secured therebetween, to be secured to the embroidery machine for the embroidery operation. This also permits a ganged embroidery machine to embroider a number of garments at one time rather than a single garment.

However, a major problem exists in the use of tubular hoops. Because the methods and devices heretofore used for positioning a garment between the male and female hoop portions have been neither accurate nor precise, the number of flawed garments turned out by embroidery machines has been high. Quite often a garment is improperly secured between the male and female hoop portions, resulting in the embroidery being in the wrong position or in being misaligned or skewed. As embroidery is for all intents and purposes permanent, each flawed garment represents a loss to the embrodierer.

Another problem that exists in the process of using tubular hoops in the embroidery process is the amount of time necessary to properly secure a garment between the male and female hoop portions. It is difficult and very time consuming to measure by hand the proper positioning and alignment for a hoop on a garment. What is more, when measuring by hand it is very easy to make a mistake. Placing the garment between the hoops by sight is much faster, but results in far more mistakes and incurred cost. The problem with many of the devices of the prior art is that they incorporate far too many steps that are carried out by hand measurement or by sight alone. Not only does using the hooping devices of the prior art require too much time, but there is also a higher risk of error.

There are other commercially available devices for aiding in placing a garment between a pair of embroidery hoops. For example, U.S. Pat. No. 5,590,613 to Head discloses an Apparatus for Framing Fabric in Embroidery Hoops. Devices that perform a similar function are taught in U.S. Pat. No. 4,767,111 to Guenter and U.S. Pat. No. 4,561,177 to Rancer. However, none of those prior art devices provide the superior benefits of my device and hence provide the user with a simple, cost efficient device for accurately and consistently hooping tubular garments. As a first means for solving the above noted problem, I invented an apparatus known as the Tubular Hooping Device. This device is described in U.S. patent application Ser. No. 08/982,010 filed on Dec. 1, 1997 and now allowed. This application is incorporated herein by reference.

It is an object of this invention to provide devices that will permit a user to accurately locate a predetermined portion of a garment between a male hoop portion and a female hoop portion.

It is another object of this invention to provide devices that permits a user to precisely repeat the procedure of accurately locating a predetermined portion of a garment between a male hoop portion and a female hoop portion.

It is yet another object of this invention to provide devices that will allow a user to ensure that a garment having a pattern or pocket will be properly aligned when placed into the hoop portions.

SUMMARY OF THE INVENTION

The present invention is directed to alignment apparatus for a tubular hooping device that permits a user to accurately and precisely secure a portion of a garment to be embroidered between a male hoop portion and a female hoop portion of an embroidery hoop. Each apparatus, used alone or in conjunction with the other, allows the hooped garment to be properly mounted adjacent a sewing head of an embroidery machine for embroidering.

As discussed above, tubular hooping devices are known in the art. In their simplest embodiments, these devices typically comprise a base, a hooping rack and mechanisms for locating and supporting at least one portion of the embroidery hoop. The base support structure is generally secured to a work surface to keep the tubular hooping device from moving during use. The hooping rack is attached to the support structure and typically extends at either an angle or perpendicular from the base support structure. The hooping rack may be smaller than the garment to be embroidered or may be sized to approximate the garment to be embroidered. For example, the hooping rack may resemble the form of a shirt. In addition, the rack may include other devices, such as shoulder forms or side extensions, to properly maintain the garment on the rack.

A first locating and supporting mechanism may be sized to receive a female hoop portion and is typically formed on or in the top side of hooping rack. A second locating and supporting mechanism may be positioned coaxial to the first mechanism. In my Tubular Hooping Device the second locating and supporting mechanism is configured to receive, support and guide the male hoop portion into the female portion during the hooping process. The mechanisms described in detail below are those described and claimed in my patent entitled "Tubular Hooping Device."

My first embodiment of the invention provides an alignment apparatus for a tubular hooping device for accurately and precisely seating a first embroidery hoop portion within a second embroidery hoop portion and securing therebetween a portion of fabric to be embroidered comprising a disk member having at least one planar surface and sized to be received within the first embroidery hoop portion; aligning indicia inscribed upon the planar surface; and the disk member being removably located within the first hoop portion.

An alternative embodiment further provides the disk member having a mechanism capable of engaging with the first embroidery hoop portion and the mechanism being removably engaged with the first hoop portion. Another embodiment of the alignment apparatus is disclosed wherein the mechanism comprises an alignment bar having two ends, at least one locating device being attached to at least one bar end, and said locating device being removably received within said first hoop portion.

In yet another embodiment the aligning indicia includes at least one line inscribed upon said disc. This embodiment may also be described as an apparatus for a tubular hooping device for accurately and precisely seating a first embroidery hoop portion within a second embroidery hoop portion and securing therebetween a portion of fabric to be embroidered comprising a planar member sized to be received within a first embroidery hoop, said planar member having at least one flat surface, alignment indicia being imprinted upon said member; a locating mechanism being attached to said member, and said locating mechanism being capable of engaging with said first embroidery hoop.

My second embodiment of the invention provides an alignment apparatus for a tubular hooping device for accurately and precisely seating a first embroidery hoop portion within a second embroidery hoop portion and securing therebetween a portion of fabric to be embroidered and where the hooping device includes a base plate, the embodiment comprising a measuring device having a longitudinal axis and an elongated opening being formed along a portion of said axis, at least one attachment mechanism connected to said base plate, and said attachment mechanism adjustably coupling said measuring device to said base plate.

An alternate second embodiment of the invention provides an alignment apparatus for a tubular hooping device for accurately and precisely seating a first embroidery hoop portion within a second embroidery hoop portion and securing therebetween a portion of fabric to be embroidered and where the hooping device includes a base plate, the alternate embodiment including a measuring device having a longitudinal axis and an elongated opening being formed along a portion of said axis, a slidable guide sized to be received by said base plate, at least one attachment mechanism connected to said guide, and said attachment mechanism adjustably coupling said measuring device to said guide.

In another alternative embodiment, registration indicia is imprinted upon said measuring device, the measuring device comprises a T-square or the measuring device comprises a scale.

The invention includes a method for properly aligning a portion of a garment to be embroidered between a male hoop portion and a female hoop portion. A female hoop portion is placed in or on the hooping rack such that it engages with the location and alignment mechanisms attached thereto. Next, the portion of the garment to be embroidered is arranged over the female hoop portion on the hooping rack. The aligning apparatus is placed within the male hoop portion. The male hoop portion is brought into close contact with the female portion. The user can then reference the template formed on the aligning apparatus to make final adjustments to the garment position. Once the garment is properly positioned, pressure is applied to securely seat the male hoop portion within the female hoop portion. The portion of the garment to be embroidered is thereby secured between the male hoop portion and the female hoop portion, the portion of the garment to be embroidered being properly centered and aligned within the male and female hoop portions.

The invention also includes a method for properly aligning a portion of a garment to be embroidered between a male hoop portion and a female hoop portion wherein an adjustable alignment apparatus is attached to a hooping device. A female hoop portion is placed in or on the hooping rack such that it engages with the location and alignment mechanisms attached thereto. Next, the portion of the garment to be embroidered is arranged over the female hoop portion on the hooping rack and its edge or crease is aligned with the alignment apparatus. Once the garment is properly positioned, pressure is applied to securely seat the male hoop portion within the female hoop portion. The portion of the garment to be embroidered is thereby secured between the male hoop portion and the female hoop portion, the portion of the garment to be embroidered being properly centered and aligned within the male and female hoop portions.

The invention also contemplates a third method whereby both aligning devices are utilized, as described above, during the hooping process.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
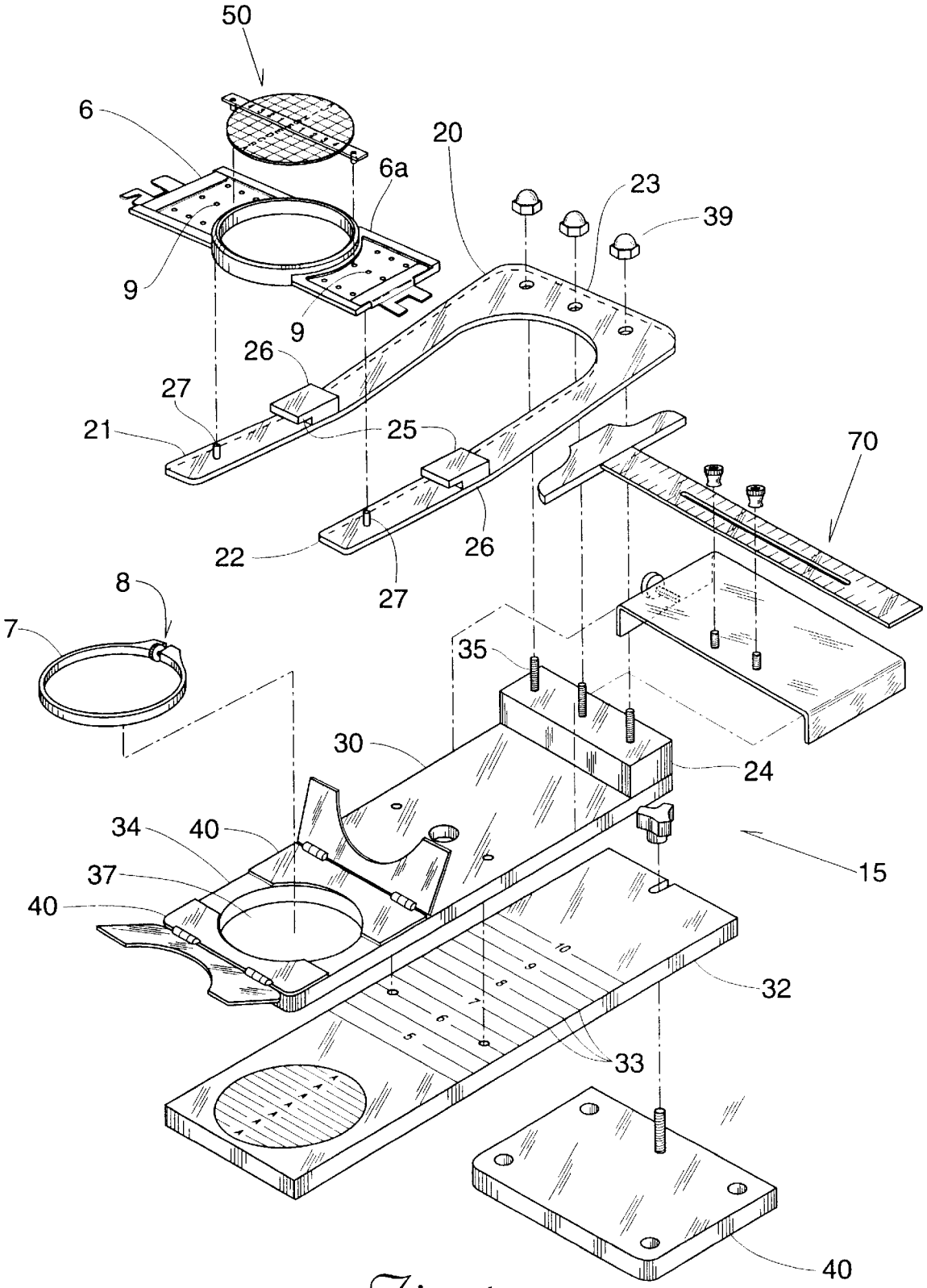
FIG. 1 is an exploded perspective view of a tubular hooping device including the alignment apparatus.

The present invention provides a reliable and efficient means for properly aligning a garment between a pair of embroidery hoops before the garment is secured between the embroidery of hoops. As seen in FIG. 1, the tubular hooping device of my prior invention 15 is essentially comprised of a flexible aligning arm 20 mounted to a base plate 30. The base plate 30 in turn rests upon a hooping rack 32. The aligning arm 20, the base plate 30, and the hooping rack 32 are, in this embodiment, mounted upon a base support structure 40.

As can be seen in FIG. 1, the base plate 30 has a recess 37 formed into its distal end 34. The recess 37 is shaped so as to receive a typical female hoop portion 7. A notch (not shown) may be cut into the proximal end of the recess 37 so as to receive an aligning and adjusting means 8 of the female hoop portion 7. The aligning and adjusting means 8 allows the nominal diameter of the female hoop portion 7 to be altered to account for various thickness of materials to be embroidered or to adjust the amount of force necessary to seat the male hoop portion 6 within the female hoop portion 7. The aligning and adjusting means 8 also allows the female hoop portion 7 to be positively oriented within the recess 37.

In embroidering garments it is not desirable to embroider a single thickness of fabric. Rather, it is the industry practice to place a piece of backing material behind the particular portion of a garment that is to be embroidered. The backing material serves to strengthen the fabric being embroidered. In order to ensure that the backing material is located behind a particular portion of a garment to be embroidered, at least one location means 40 has been provided on the distal end of the base plate 30, immediately adjacent the keyed recess 37. In this embodiment, the location means 40 comprises a pair of metal bottom plates hinged to magnetic top plates. Only one of the bottom or top plates need be magnetic, so long as the magnetic force generated between plates and is sufficient to maintain the backing material in its desired position.

The aligning arm 20 illustrated in FIG. 1 is designed to accurately seat the male hoop portion 6 within the female hoop portion 7. The aligning arm is comprised of a first finger 21 and a second finger 22 connected at their proximate ends by a web 23. The aligning arm 20 is supported above the base plate 30 at the web 23 upon a spacer 24. Both the spacer 24 and the aligning arm 20 are secured to the support structure 40 by bolts 35. Nuts 39 are threaded upon bolts 35 to secure the aligning arm 20, spacer 24, and base plate 30 together. In the embodiment of FIG. 1, it is preferred to fabricate the aligning arm 20 from a polycarbonate material, though it is to be understood that any material possessing similar structural characteristics could be employed.

Locating and aligning mechanisms for repeatably and accurately positioning the male hoop portion 6 upon the distal end of the fingers 21 and 22 of the aligning arm 20 are also illustrated in FIG. 1. The mechanisms consist of a pair of positioning blocks 26, one mounted on each of the fingers 21 and 22 and a pair of positioning pins 27 located distal to the positioning blocks 26. The positioning blocks 26 form a slot 25 on each finger 21 and 22 capable of receiving an edge 6*a* of the male hoop portion 6. The positioning pins 27 are located on the fingers 21 and 22 so as to mate with corresponding holes 9 formed through the male hoop portion 6.

As can be seen from FIG. 1, the location of the positioning pins 27 can vary so long as the positioning pins 27 mate with holes 9 of the male hoop portion 6. The complementary action of the slots 25 and the positioning pins 27 serve to positively locate the male hoop portion 6 upon the fingers 21 and 22 of the aligning arm 20. Other male hoop portions will require different, yet equivalent, positioning structures. An equivalent structure may be a positioning peg having a rectangular shape that is received within a rectangular opening in a male hoop portion 6. Another equivalent positioning structure may comprise one or more recesses formed in the bottom surface of the male hoop portion and one or more plates mounted on the aligning arms and positioned to receive the recesses. Although the general structure of all male hoop portions utilized in embroidery machines are somewhat similar, it should be noted and appreciated that different embroidery machine manufacturers have different hoop designs and that different positioning structures and different aligning arms may be utilized without deviating from the present invention.

Figure 2:
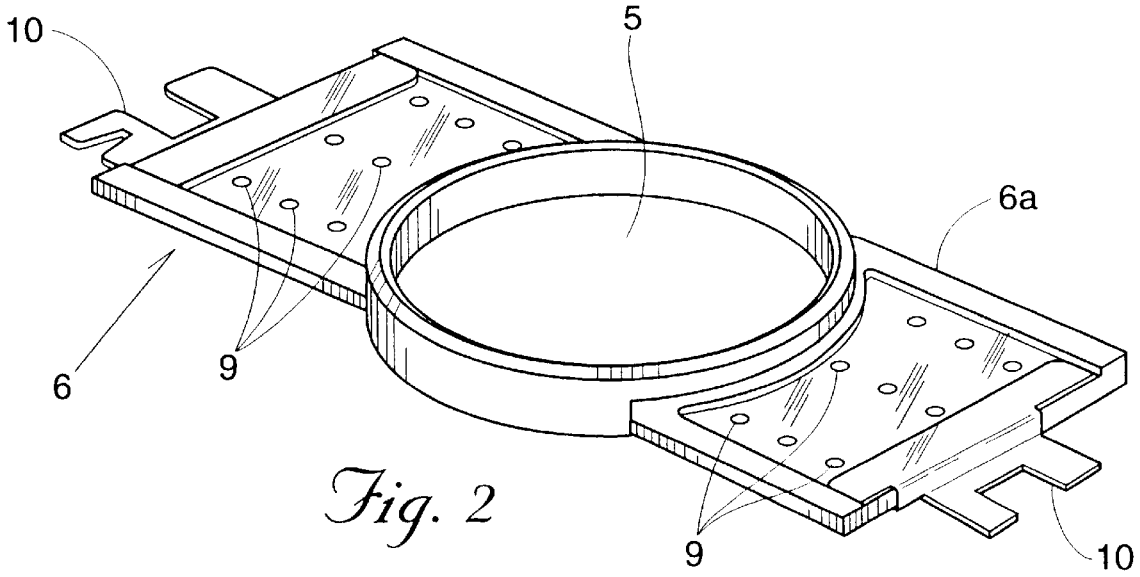
FIG. 2 is a perspective view of a male portion of a typical tubular hoop.
Figure 3:
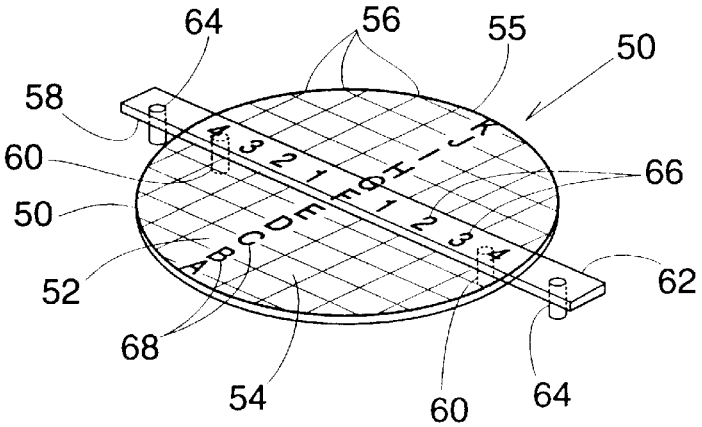
FIG. 3 is a perspective view of the first embodiment of the alignment apparatus.

The first aligning apparatus of the present invention is shown at reference numeral 50 in FIGS. 1 and 3. The apparatus 50 includes a disc-shaped body 52 having an upper surface 54 and a lower surface 55. A plurality of registration markings 56 is inscribed on one or both surfaces 54 and 55. A hoop engaging mechanism 58 is attached to the upper surface 54 by means of a pair of blocks 60. The hoop engaging mechanism 58 has two ends 62. A locating pin 64 is attached at each end. Each locating pin 64 is sized and positioned to be received within one of the openings 9 formed in the male hoop portion 6 (FIG. 2).

A feature of the alignment apparatus 50 shown in FIG. 3 is the registration numerals 66 and the registration letters 68. Each of the registration numerals 66 correspond to a particular vertical line and each of the registration letters 68 correspond to a particular horizontal line. Using the registration numerals 66 and letters 68, a user of the instant invention can readily locate and align a predetermined portion of the garment, such as a pocket, stripe or pattern, with the hooping device 15 to insure that the embroidery is properly aligned on the garment. Further, the registration letters 68 are used in conjunction with the registration numerals 66 to ensure that each garment to be embroidered is arranged upon the hooping rack 32 in the same manner as the previous garment to be embroidered. By noting the intersection of the registration numeral 66 and registration letter 68, the user of the instant invention can easily reproduce the hooping results achieved with the first garment. Using the aligning apparatus 50 with the tubular hooping device 15, the user may also be assured that garments having distinct patterns and shirt pockets will be accurately and precisely hooped.

Figure 4:
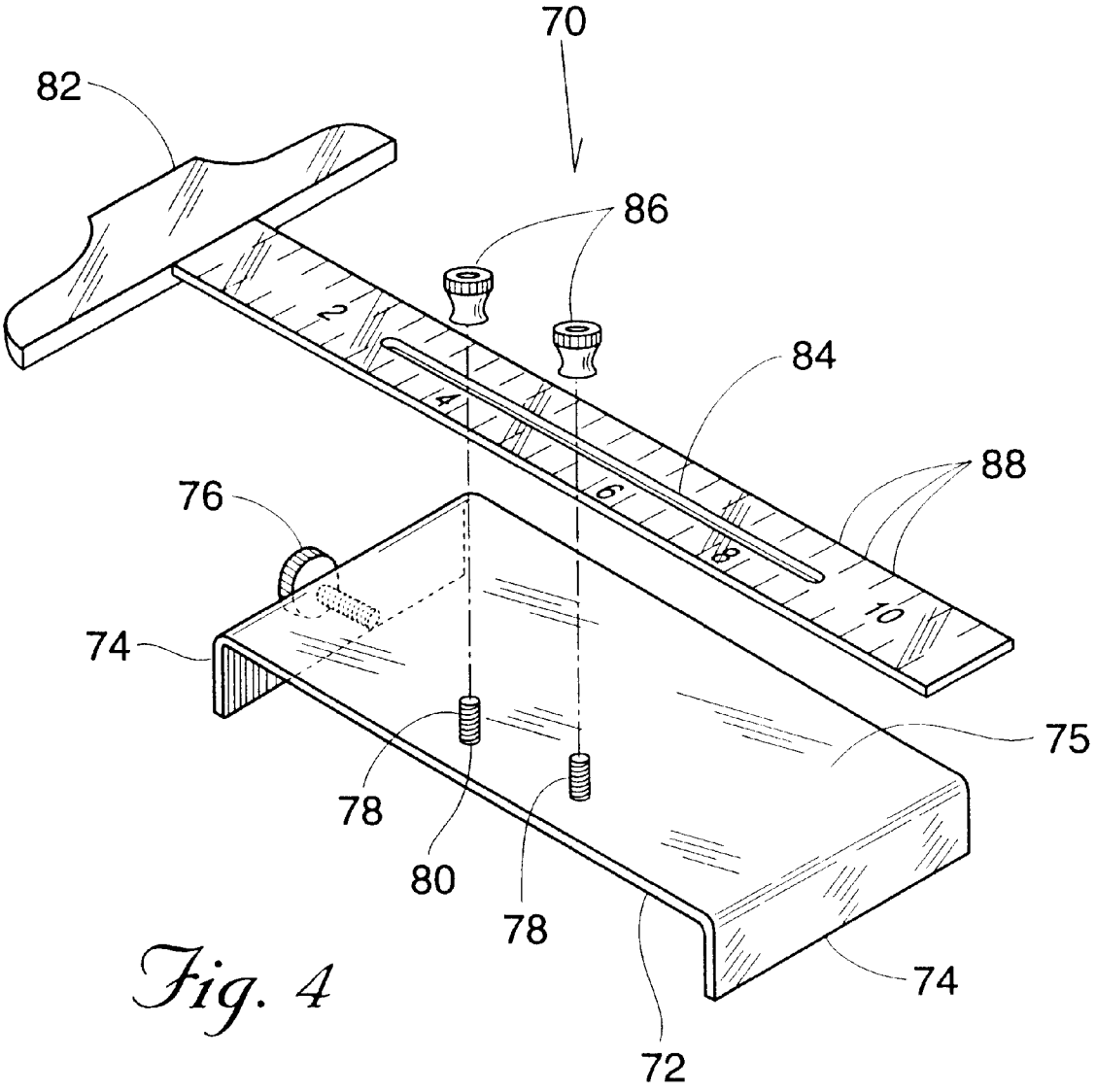
FIG. 4 is a perspective view of the second embodiment of the alignment apparatus.
Figure 5:
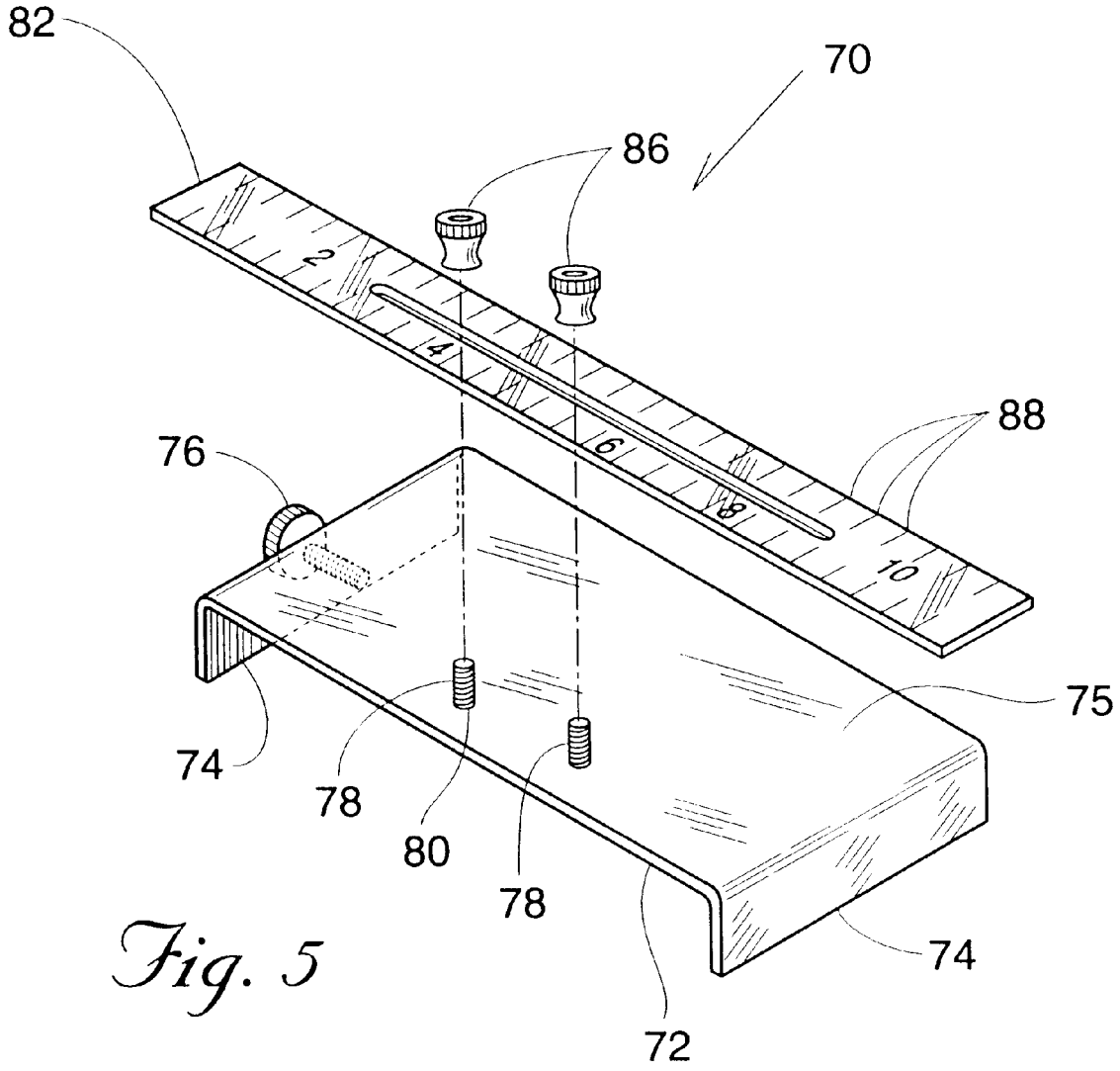
FIG. 5 is a perspective view of an alternate second embodiment of the alignment apparatus.
Figure 6:
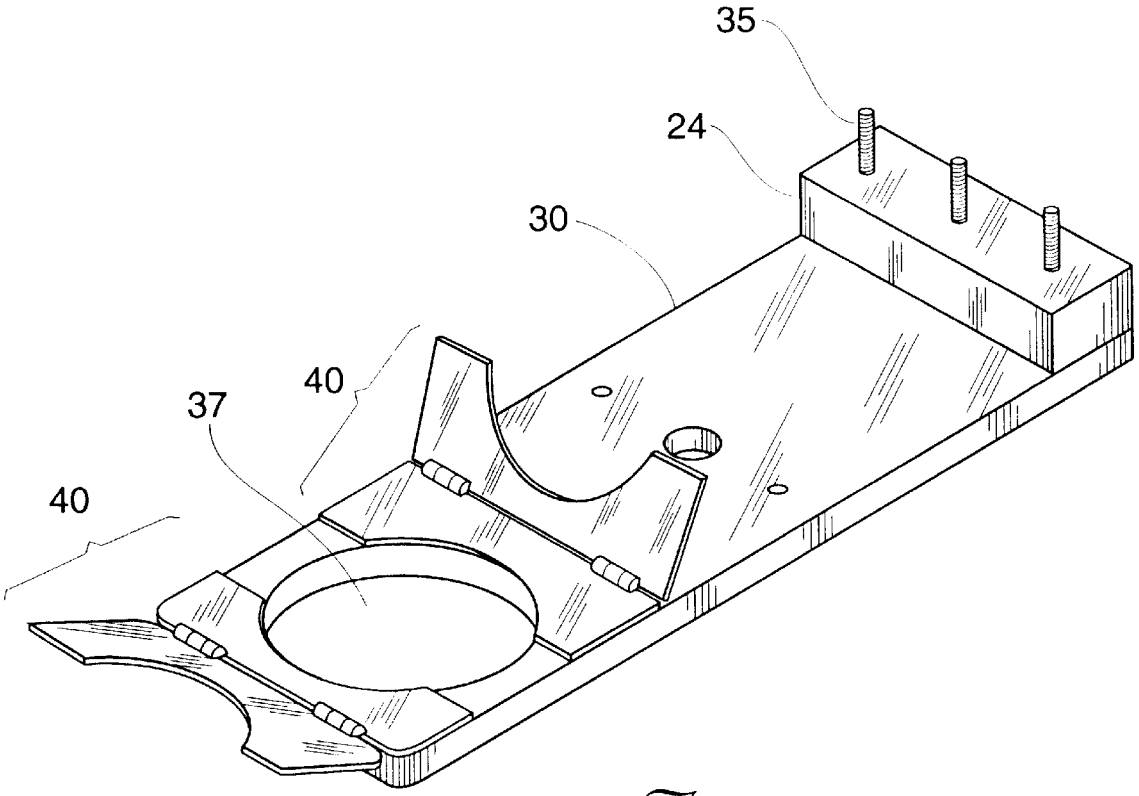
FIG. 6 is a perspective view of the base plate.

The second aligning apparatus 70 is shown in FIGS. 1, 4 and 5. The apparatus includes a sliding guide 72 having a pair of legs 74. The guide 72 is sized to fit over the base plate 30 such that the legs 74 are in substantial contact with the sides of the base plate. A thumbscrew 76 is threadedly received within one the legs 74. The thumbscrew 76 is used to lock the sliding guide 72 in place on base plate 30. A pair of threaded studs 78 extend upward from openings 80 formed in the top surface 75 of the sliding guide 72.

A measuring device 82, such as a scale (FIG. 5) or a T-square (FIG. 4) is positioned over the sliding guide 72. The measuring device 82 has an elongated opening 84 formed along its longitudinal axis. The threaded studs 78 extend through the elongated opening 84. A pair of thumb nuts 86 is provided to releasably lock the measuring device 82 to the sliding guide 72. Positioning indicia 88 is inscribed upon the measuring device 82 to assist the user in properly adjusting the measuring device 82 with respect to the sliding guide.

The second aligning apparatus is used as follows. A female hooping portion 7 is first placed in the recess 37 of base plate 30 as illustrated in FIG. 1. Next, a first garment to be embroidered is placed over the base plate 30 and hooping rack 32. Sliding guide 72 and scale 82 are aligned with an edge of the garment, such as a fold in the fabric, to insure proper lateral alignment of the garment with the hooping device. Once their proper position is determined, thumbscrew 76 and thumb nuts 86 are tightened. Once the sliding guide 72 and scale 82 are properly positioned with respect to the garment, no adjustments will be necessary for identical garments. The properly aligned position can be noted by making reference to the gradients inscribed on the scale 82 as well as the indicia 33 on hooping rack 32. If the same garments are to be hooped in the future, the proper position for this aligning apparatus can be readily and easily re-set.

Next, aligning apparatus 50 of the present invention is placed within the opening 5 of the male hoop portion 6 such the locating pins 64 each fit within one of the openings 9. The male hoop portion 6 is releasably located upon the aligning arm 20, which is resiliently biased away from the base plate 30. As the male hoop portion 6 is forced downward towards the base plate 30, the operator utilizes the registration marks inscribed upon the aligning apparatus 50 to insure that the garment is properly positioned with respect to the hoop. When the proper alignment has been achieved, the male hoop portion 6 is biased down further the causing the male hoop portion to be received within the female hoop portion 7.

Another method of using these embodiments comprises the steps of placing a suitably sized female hoop portion 7 in the recess 37, opening the location means 40 by rotating the top plates away from the bottom plates, placing backing material over the keyed recess 37, and securing the backing material in place by closing the location means 40 upon the backing material by rotating the top plates into physical contact with the backing material and into magnetic contact with the bottom plates. Once the backing material is in place, the portion of the garment to be embroidered is positioned over the hooping rack 32 with the desired portion being aligned with aligning apparatus 70. When the garment is in its predetermined position, the male hoop portion 6 is releasably inserted into the slots 25 of the positioning blocks 26 such that positioning pins 27 mate with holes 9. Aligning apparatus 50 is placed within opening 5 of male hoop portion 6 as previously described. The operator of the tubular hooping device 15 then brings the male hoop portion 6 into close contact with the garment, makes any initial adjustments to garment position, and finally forces the male hoop portion 6 into mating contact with the female hoop portion 7, thereby securing the portion of the garment to be embroidered and the backing material between the male and female hoop portions 6 and 7. The hooped garment is removed from the tubular hooping device 15 and is mounted upon an embroidery machine by means of the connecting brackets 10 (FIG. 2). This procedure is quickly repeatable and yields results that are both more accurate and more precise than other known methods and devices for hooping garments.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An alignment apparatus of a tubular hooping device for accurately and precisely seating a first embroidery hoop portion within a second embroidery hoop portion and securing therebetween a portion of fabric to be embroidered, the apparatus comprising:

a disk member having at least one planar surface and sized to be received within the first embroidery hoop portion;

aligning indicia inscribed upon the planar surface;

the disk member being removably located within the first hoop portion the disk member having a mechanism engageable with the first embroidery hoop portion;

the mechanism being removably engaged with the first hoop portion the mechanism comprising an alignment bar having two ends;

at least one locating device being attached to at least one bar end; and said locating device being removably received within said first hoop portion.

2. An alignment apparatus of a tubular hooping device for accurately and precisely seating a first embroidery hoop portion within a second embroidery hoop portion and securing therebetween a portion of fabric to be embroidered, the apparatus comprising:

a planar member sized to be received within a first embroidery hoop;

said planar member having at least one flat surface;

alignment indicia being imprinted upon said member;

a locating mechanism being attached to said member;

said locating mechanism having at least one bar end; and said bar end being capable of engaging with said first embroidery hoop.

3. An alignment apparatus of a tubular hooping device for accurately and precisely seating a first embroidery hoop portion within a second embroidery hoop portion and securing therebetween a portion of fabric to be embroidered, the hooping device including a base plate, the apparatus comprising:

a measuring device comprising a guide member slidably mounted on said base plate and said measuring device having a longitudinal axis and an elongated opening being formed along a portion of said axis;

at least one attachment mechanism for releasably retaining said guide member relative to said base plate; and said attachment mechanism adjustably coupling said measuring device to said base plate.

4. An alignment apparatus of a tubular hooping device for accurately and precisely seating a first embroidery hoop portion within a second embroidery hoop portion and securing therebetween a portion of fabric to be embroidered, the hooping device including a base plate, the apparatus comprising:

a measuring device having a longitudinal axis and an elongated opening being formed along a portion of said axis;

at least one attachment mechanism connected to said base plate;

said attachment mechanism adjustably coupling said measuring device to said base plate; and said measuring device comprising a T-square.

5. The apparatus of claim 4 wherein registration indicia is imprinted upon said measuring device.

6. An alignment apparatus of a tubular hooping device for accurately and precisely seating a first embroidery hoop portion within a second embroidery hoop portion and securing therebetween a portion of fabric to be embroidered, the hooping device including a base plate, the apparatus comprising:

a measuring device having a longitudinal axis and an elongated opening being formed along a portion of said axis;

a slidable guide sized to be received by said base plate;

at least one attachment mechanism connected to said guide;

said attachment mechanism adjustably coupling said measuring device to said guide; and said measuring device comprises a T-square.

7. The apparatus of claim 6 wherein registration indicia is imprinted upon said measuring device.

8. An alignment apparatus of a tubular hooping device for accurately and precisely seating a first embroidery hoop portion within a second embroidery hoop portion and securing therebetween a portion of fabric to be embroidered, the hooping device including a base plate, the apparatus comprising:

a measuring device comprising a guide member slidably mounted on said base plate and said measuring device having a longitudinal axis and an elongated opening being formed along a portion of said axis;

at least one attachment mechanism for releasably retaining said guide member relative to said base plate;

said attachment mechanism adjustably coupling said measuring device to said base plate; and said measuring device comprises a T-square.

* * * * *